United States Patent [19]

Bartsch

[11] Patent Number: 4,815,420

[45] Date of Patent: Mar. 28, 1989

[54] TWO-STROKE INTERNAL COMBUSTION ENGINE

[76] Inventor: Christian Bartsch, Ulmenweg 6, 6110 Dieburg, Fed. Rep. of Germany

[21] Appl. No.: 88,345

[22] Filed: Aug. 24, 1987

Related U.S. Application Data

[63] Continuation of PCT DE86/00511, Dec. 15, 1986.

[30] Foreign Application Priority Data

Dec. 23, 1985 [DE] Fed. Rep. of Germany ... 8536426[U]
Jun. 4, 1986 [DE] Fed. Rep. of Germany ..... 3618797

[51] Int. Cl.[4] ..... F02B 75/02
[52] U.S. Cl. ..... 123/65 P; 123/73 C
[58] Field of Search ..... 123/65 R, 65 A, 65 VB, 123/65 P, 65 BA, 73 C, 663

[56] References Cited

U.S. PATENT DOCUMENTS

| | | | |
|---|---|---|---|
| 1,429,078 | 9/1922 | Hutchinson . | |
| 1,605,381 | 11/1926 | Wirrer | 123/663 |
| 1,688,767 | 10/1928 | Webb . | |
| 1,750,201 | 3/1930 | Spencer et al. . | |
| 1,952,275 | 3/1934 | Mohr | 123/65 PE |
| 2,071,125 | 2/1937 | Jehle | 123/663 |
| 2,075,232 | 3/1937 | Schneider | 123/65 P |
| 2,110,754 | 3/1938 | Alston | 123/65 BA |
| 2,111,282 | 3/1938 | Edwards | 123/65 BA |
| 2,169,652 | 8/1939 | Ljungstrom | 123/65 PE |
| 2,504,243 | 4/1950 | Anderson | 123/65 V |
| 2,724,372 | 11/1955 | Schowalter | 123/65 |
| 2,840,062 | 6/1958 | Classen | 123/65 |
| 3,203,409 | 8/1965 | Allen | 123/65 V |
| 3,815,558 | 6/1974 | Tenney . | |

FOREIGN PATENT DOCUMENTS

| | | | |
|---|---|---|---|
| 500785 | 4/1952 | Belgium . | |
| 2620408 | 11/1977 | Fed. Rep. of Germany . | |
| 628587 | 10/1927 | France . | |
| 2566459 | 12/1985 | France . | |
| 0032036 | 4/1981 | Japan | 123/65 PE |
| 154285 | 7/1932 | Switzerland . | |
| 1174576 | 8/1985 | U.S.S.R. | 123/663 |
| 179628 | 6/1922 | United Kingdom . | |
| 464750 | 5/1937 | United Kingdom . | |

OTHER PUBLICATIONS

International Search Report for the corresponding PCT application PCT/DE86/00511.

*Primary Examiner*—Charles J. Myhre
*Assistant Examiner*—David A. Okonsky
*Attorney, Agent, or Firm*—Wegner & Bretschneider

[57] ABSTRACT

An internal combustion engine includes a single sluice (3) which opens asymmetrically and one-sidedly in an exhaust channel (5) and which runs tangentially within the cylinder (1), diagonally to the cylinder head. A rotating flow is thus obtained in the cylinder along its inner wall, thus ensuring a complete and reliable ignition, a low fuel consumption and a low pollutant content in the exhaust gases.

13 Claims, 2 Drawing Sheets

TWO-STROKE INTERNAL COMBUSTION ENGINE

CROSS-REFERENCE TO RELATED APPLICATION

This application is a continuation of United States application Ser. No. PCT/DE86/00511, filed Dec. 15, 1986, which was filed as an international application.

BACKGROUND OF THE INVENTION

The invention relates to a two-stroke internal combustion engine in which the fresh gas is led tangentially and upwards in an inclined manner into the cylinder and which instead of a crankcase pump has an additional loader to deliver the fresh gas into the cylinder. Such an internal combustion engine is disclosed in DE-PS No. 454 473.

The internal combustion engine already known is a two-stroke Diesel engine of large volume and slow running. In this engine the scavenging air is led tangentially into the cylinder through several scavenging air ducts. The combusted gas leaves the cylinder accordingly through several exhaust channels that are arranged at the opposite side of the scavenging air ducts.

The internal combustion engine already known cannot work in an optimal manner because a lot of the incoming air directly reaches the exhaust channels instead of first rotating in the cylinder. This leads to a relatively high short circuit loss. In the internal combustion engine already known the rotation of the air is restrained by turbulences and the back-flow in the middle of the cylinder.

The piston with a lug as shown in FIGS. 3 and 4 of the drawing of DE-PS No. 454 473 proves that the inventor had at least guessed at the effect of the short circuit loss. But experience shows that a deviation lug on the piston cannot improve a bad scavenging. This applies to the same extent to the internal combustion engine according to the Austrian Pat. No. 113 633.

Two-stroke internal combustion engines with spark ignition were used until after the Second World War because of their easy construction and their high specific power. Furthermore there is much less $NO_x$ in the exhaust gas of these two-stroke engines than in comparable four-stroke engines which is a result of the mixture of fresh gas and exhaust gas in the cylinder. To gain these advantages, however, one so far had on the other hand to accept a great fuel-consumption and a high portion of CO and HC in the exhaust gas during idle running and in the part-load area. A further disadvantage was the fact that no proper idle running with ignition at each stroke could be reached. This led to a disagreable vibration during idle running speed. Because of these disadvantages two-stroke engines have no longer been used as drive for automobiles for about three decades.

The object of the present invention is to develop a two-stroke internal combustion engine as mentioned at the beginning in such a way that it can work with smooth running and high efficiency as a Diesel engine but also as an internal combustion engine with spark ignition (Otto engine) and that it is more advantageous as far as fuel-consumption and portion of pollutant content in the exhaust gases are concerned than conventional Diesel engines, two-stroke and four-stroke internal combustion engines with spark ignition.

This object is achieved according to the invention by providing only a single sluice with one scavenging port leading into the cylinder and by arranging the sluice at the same side of the cylinder as the exhaust port and next to it.

Due to the arrangement according to the invention the incoming fresh gas forms a rotating drum along the wall of the cylinder. The admission velocity can nearly fully be converted into a rotary motion so that the fresh gas vortex rotates at a high speed. Since the intake duct is inclined in direction of the combustion chamber the fresh gas reaches the combustion chamber on a defined way even in case of low rotational speed and can be safely ignited when petrol is used. Tests with this scavenging resulted in a smooth idle running in case of very low rotational speed and in a perfect ignition at each stroke.

In spite of its functional advantages the construction of the internal combustion engine according to the invention is much easier than that of conventional two-stroke engines because its basic structure—crankshaft, crankcase, lubrication—is that of a four-stroke engine and the cylinder wall only has two openings, i.e. the exhaust port and the scavenging port. Thus also a multi-cylinder engine of simple cast technic with small cylinder distances can be produced.

Due to the arrangement according to the invention one does—contrary to the prior art—achieve an optimal scavenging of the combusted gas especially in the partload area and avoids a mixing of fresh gas and residual gas. It is the object of the invention to completely separate the fresh gas from the residual gas in order to reach a laminated charge and lean operating even in case of little partial load. The arrangement according to the invention is the only means to achieve this object in the easiest possible way.

The flow in the sluices has especially little loss if according to an advantageous embodiment of the invention they are running mostly straight-lined and are narrowing towards the cylinder. Furthermore this arrangement leads to a particularly high rotational speed of the fresh gas vortex.

It is also advantageous if a back-flow stop in the form of non-return valves is provided between the loader and the sluice. This prevents a back-flow of combusted gas from the cylinder into the loader. Such non-return valves can for example be leaf-valves such as they are used nowadays on the intake side of some conventional two-stroke engines. They open automatically once the pressure in the cylinder is falling below that of the loader. Besides they have so little flow-resistance that they do not restrain the gas-flow and do not require an additional power consumption.

According to another advantageous embodiment of the invention one can instead of a non-return valve provide a stopping device that is driven by the internal combustion engine either direct or according to a programme. It is particularly convenient if the stopping device is a rotary slide valve. Such rotary slide valves are especially advantageous in the case of multi-cylinder engines. This rotary slide valve is made as known in such a manner that the fresh gas enters the duct at a front end and flows through this duct towards the control openings. The rotary slide valve can be driven by toothed belts, chains or gears.

The drive of the rotary slide valve is particularly simple if the rotary slide valve is arranged parallel to the crankshaft.

A control element such as it has for example been developed by the firm Pierburg for the shifting of camshafts is inserted between the rotary slide valve and the drive. Thus the delivered air is adapted to the requirements of the engine in an optimal manner and a usual choke control is no longer necessary.

The adjustment is carried out automatically by means of an electronic control element which processes load, rotational speed, pressure and temperature. This control element can be combined with that for the ignition point and the fuel injection so that in that case also the air volume and air mass are further factors of influence. The replacement of the usual choke control by the control edge of the rotary slide valve ensures that when the control edge of the rotary slide valve is opened the full load pressure always causes a high speed of the fresh gas in the passage way. Besides it is possible to completely close the control opening when running downhill by pushing force so that a saving of fuel is reached.

In the case of petrol injection and its cut-off during the pushing force phase the electronic can also produce a higher throughput of air and by a higher compression work in the cylinder and in the loader a quicker slowing-down of the motor speed.

It is also of advantage if the scavenging port is opened by a greater crank angle than the exhaust port and if the lower edge of the scavenging port is considerably higher than the controlling upper edge of the piston in the bottom dead centre. In such an arrangement the fresh gas can flow for a longer period from the upper edge of the piston into the cylinder without being influenced.

Although Swiss Pat. No. 268 279 shows spill ports the upper edges of which are arranged higher than those of the exhaust ports such an engine cannot run because such an arrangement of the ports is only useful in the case of forced loading. The spill-slide described in the same patent is also useless because the patent expressly concerns a two-stroke engine with crankcase scavenging. In two-stroke engines with crankcase scavenging it is necessary that when the piston goes down after opening of the spill ports combusted gas presses into the crankcase which leads on the one hand to higher pressure and on the other hand to a spilling later on. Two-stroke engines with a crankcase pump and spilling that is not controlled mechanically anyhow work "unsymmetrically" when the gas is changed and can be so much deteriorated by the devices according to Pat. No. 268 279 that they are unable to run by themselves.

If the combustion chamber is built as an annular channel the structure of the internal combustion engine is simple and high thermal loads are prevented. But the combustion chamber can also be built in form of a disk or in a form that is between a disk and an annular channel.

It is also advantageous if in the embodiment as Otto engine the sparking plug is provided at the outside of the combustion chamber periphery because the mixture rotating there is particularly easy to ignite so that the ignition is reliable even in case of low rotational speed. Thus a two-stroke Otto engine is realized that has the advantages of a usual two-stroke engine but not the disadvantages of a bad efficiency, a bad true running in the part-load area and a high portion of pollutant content in the exhaust gases.

The ignition is particularly reliable if according to another embodiment of the invention two sparking plugs are provided staggard by 180 degrees at the outside of the combustion chamber periphery.

In order to remove remaining unbalances of the crankshaft drive the rotary slide valve can at the same time be formed as compensating shaft.

The invention permits of numerous modifications. Some of them are shown very schematically in the drawing and are described below. In the drawing FIG. 1 is a horizontal section through an internal combustion engine according to the invention in which for better understanding the intake and exhaust channel have been shown in the section.

Figure 1:
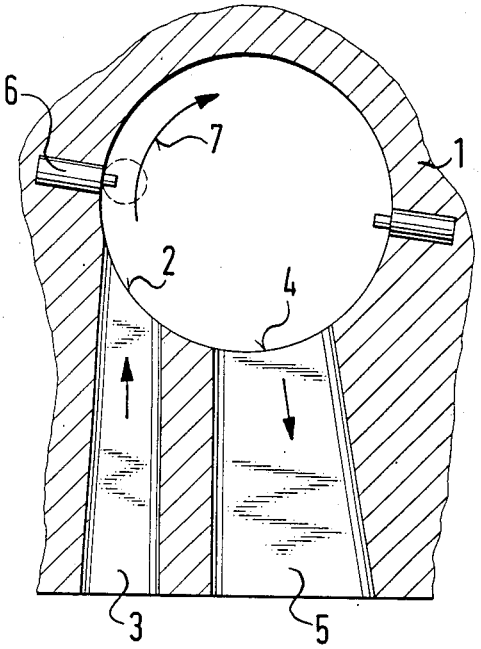

FIG. 1 shows a cylinder 1 of an internal combustion engine in which is led tangentially and through a scavenging port 2 a straight-lined sluice 3 that is narrowing towards the cylinder 1. Next to the scavenging port 2 there is an exhaust port 4 through which combusted gas is leaving the cylinder 1 and will reach via the exhaust channel 5 the exhaust that is not shown in the drawing. Near the internal periphery surface of cylinder 1 a sparking plug 6 is shown in broken lines that is arranged in the head of the cylinder and therefore can actually not be seen in the section view. Not shown is a loader from which fresh gas is entering via the scavenging duct 2 into the cylinder 1 to form a fresh gas vortex there that is indicated by an arrow 7.

Figure 2:
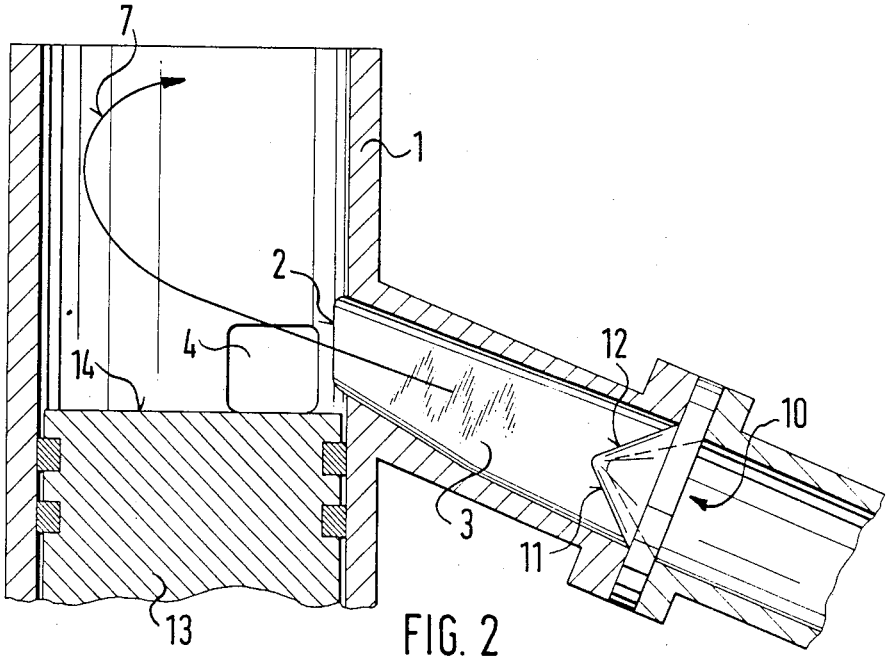
FIG. 2 is a vertical section through an internal combustion engine according to the invention in the area of the intake duct.

FIG. 2 shows that the sluice 3 is directed upwards into the cylinder 1 in an inclined manner. Thus a flow is formed that is accordingly directed upwards in a screw-shaped manner along the internal area of the cylindrical surface of cylinder 1 as again indicated by arrow 7. At the entrance of the sluice 3 one can see a back-flow stop 10 that is formed as a leaf valve having two leaves 11, 12 which point in the direction of the cylinder 1 and which meet at their ends.

FIG. 2 also shows a piston 13 that is indicated in the drawing in its lowest position in which the upper edge 14 of the piston 13 is below the scavenging port 2 into which the sluice 3 is leading.

Figure 3:
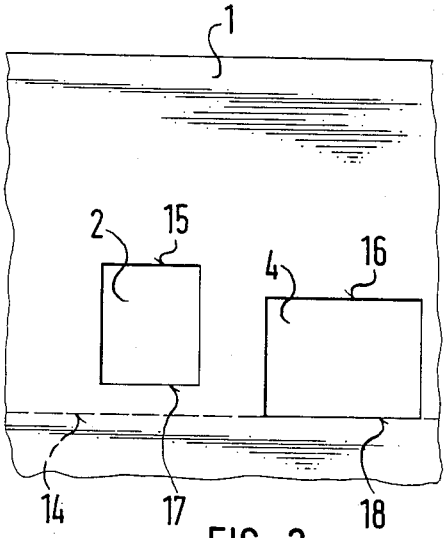
FIG. 3 is a part of a cylinder unwinding in the area of the ports of the cylinder of the internal combustion engine.

In the embodiment according to FIG. 3 the scavenging port 2 is arranged higher than the exhaust port 4 so that its upper edge 15 as well as its lower edge 17 are higher in relation to the upper edge 14 of the piston than the corresponding upper edge 16 and the lower edge 18 of the exhaust port 4.

Figure 4:
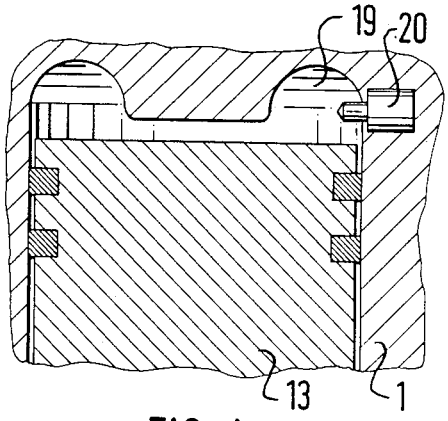
FIG. 4 is a vertical section through a second embodiment of a cylinder of the internal combustion engine according to the invention.

In the embodiment according to FIG. 4 the combustion chamber 19 is arranged as an annular channel.

Figure 5:
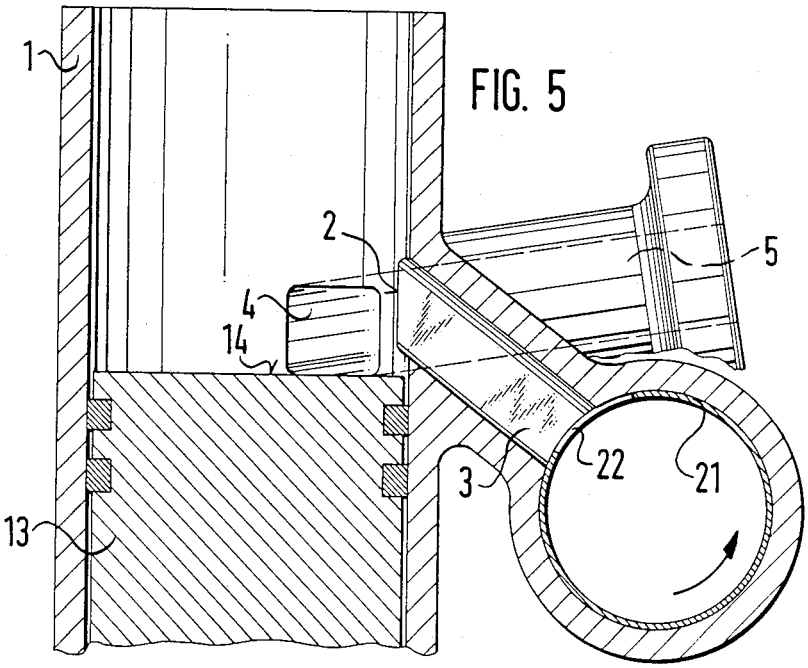
FIG. 5 is a vertical section through a cylinder of the internal combustion engine according to the invention with a rotary slide valve.

In the embodiment according to FIG. 5 there is in the sluice 3 a rotary slide valve 21 that is arranged parallel to the crankshaft not shown in the drawing. This rotary slide valve 21 is driven by the crankshaft and controls the incoming scavenging gas via a control opening 22. One can also see that in this embodiment, too, the scavenging port 2 is arranged higher than the exhaust port 4. Furthermore shown and positioned in FIG. 5 are the exhaust channel 5 and the piston 13 with its upper edge 14 being in its bottom dead centre when the piston has the position as shown in the drawing.

While the invention has been particularly shown and described in reference to preferred embodiments thereof, it will be understood by those skilled in the art that changes in form and details may be made therein without departing from the spirit and scope of the invention.

What is claimed is:

1. A two-stroke internal combustion engine, comprising:

a cylinder having fresh gas being led tangentially and upwards in an inclined manner into said cylinder so that the fresh gas led into said cylinder rotates around a vertical axis of said cylinder;

an additional loader to deliver the fresh gas into said cylinder;

a sluice with at least one scavenging port leading into said cylinder;

and at least one exhaust port through a side of said cylinder, and wherein the sluice is arranged at the same side of the cylinder as the exhaust port and next to it.

2. The internal combustion engine according to claim 1, wherein the sluice is substantially straight-lined and narrows towards the cylinder.

3. The internal combustion engine according to claim 1, wherein a back-flow stop in the form of non-return valves is provided between the loader and the cylinder.

4. The internal combustion engine according to claim 3, wherein the back-flow stop is made by a leaf valve.

5. The internal combustion engine according to claim 1, wherein a driven stopping device is inserted between the loader and the cylinder.

6. the internal combustion engine according to claim 1, further comprising a driven rotary slide valve inserted between said loader and said cylinder which is operated in such a manner that the rotary slide valve replaces the usual choke control and prevents a back-flow of combusted gas from said cylinder into said loader.

7. The internal combustion engine according to claim 6, wherein the rotary slide valve is arranged parallel to the crankshaft.

8. The internal combustion engine according to claim 1, wherein the scavenging port comprises a lower edge and is opened by a greater crank angle than the exhaust port, and wherein the lower edge of the scavenging port is considerably higher than a controlling upper edge of the piston in a bottom dead center.

9. The internal combustion engine according to claim 1, further comprising a combustion chamber in conjunction with said cylinder which is built as an annular channel.

10. The internal combustion engine according to claim 1, further comprising an injection nozzle which is provided at the outside of the combustion chamber periphery; and an injection jet which is directed through the cylinder axis generally horizontally towards the other side of the cylinder.

11. The internal combustion engine according to claim 1, further comprising a spark plug which is provided at the outside of the combustion chamber periphery.

12. The internal combustion engine according to claim 11, further comprising at least two spark plugs which are provided in a staggered manner by 180 degrees at the outside of the combustion chamber periphery.

13. The internal combustion engine according to claim 6, wherein the rotary slide valve also acts for removing remaining unbalances.

* * * * *